United States Patent [19]

Wiggins et al.

[11] 4,065,031

[45] Dec. 27, 1977

[54] PROGRAMMABLE DEVELOPMENT CONTROL SYSTEM

[75] Inventors: Douglas G. Wiggins, Rochester; Edward L. Kushall, Ontario, both of N.Y.

[73] Assignee: Xerox Corporation, Stamford, Conn.

[21] Appl. No.: 708,150

[22] Filed: July 23, 1976

[51] Int. Cl.[2] ..... B67D 5/08

[52] U.S. Cl. ..... 222/56; 222/DIG. 1

[58] Field of Search ..... 222/56, 57, DIG. 1; 355/14, 3 DD, 4; 118/646

[56] References Cited

U.S. PATENT DOCUMENTS

| | | | |
|---|---|---|---|
| 2,863,651 | 12/1958 | McBride | 222/57 X |
| 3,754,821 | 8/1973 | Whited | 355/4 X |
| 3,778,146 | 12/1973 | Knapp | 355/3 DD |
| 3,873,002 | 3/1975 | Davidson et al. | 222/DIG. 1 X |
| 3,876,106 | 4/1975 | Powell et al. | 222/57 |
| 3,974,363 | 8/1976 | Malinich | 355/14 X |

FOREIGN PATENT DOCUMENTS

| | | | |
|---|---|---|---|
| 2,408,411 | 2/1974 | Germany | 355/14 |

*Primary Examiner*—Allen N. Knowles
*Assistant Examiner*—Fred A. Silverberg
*Attorney, Agent, or Firm*—J. J. Ralabate; C. A. Green; H. Fleischer

[57] ABSTRACT

A control device in which the dispensing of particles from a storage container to a mix is regulated. At predetermined sampling intervals, the concentration of particles in the mix is detected and a signal indicative thereof generated. These signals are summed and processed by a program to develop an actuating signal. The actuation signal energizes the storage container to dispense particles into the mix.

4 Claims, 7 Drawing Figures

PROGRAMMABLE DEVELOPMENT CONTROL SYSTEM

BACKGROUND OF THE INVENTION

This invention relates generally to an electrostatographic printing machine, and more particularly concerns a control device which regulates the concentration of toner particles in the developer mix.

Many types of systems have been developed to adjust the concentration of toner particles in the developer mix. These systems generally monitor the concentration of toner particles in the developer mix and furnish additional toner particles thereto as required. The density of the resultant copy is optimized by maintaining the toner particle concentration within the developer mix at a preferred value.

Dispensing systems usually do not furnish constant quantities of toner particles into the developer mix of the development system. This is particularly true of a vibrating system where the dispense rate varies as a function of the level of toner particles in the container.

Control systems sense the concentration of toner particles within the developer mix and produces an electrical signal indicative thereof. Exemplary systems of this type are described in U.S. Pat. No. 3,754,821 issued to Whited in 1973 and U.S. Pat. No. 3,778,146 issued to Knapp in 1973. As disclosed therein, an electrically biased transparent electrode, disposed on a photoconductive surface, passes through the developer mix. While in the development zone, the transparent electrode attracts toner particles from the developer mix. The electrode is thereafter illuminated, the intensity of the light rays passing therethrough being indicative of the concentration of toner particles within the developer mix. A photosensor detects the intensity of light rays passing through the transparent electrode and develops an electrical signal proportional thereto. The electrical signal is compared with a reference and a control signal is developed to actuate the toner particle storage container. If required, the toner particle storage container dispenses additional particles to the developer mix. Thus, when the concentration of toner particles is beneath a specified level, additional toner particles are always supplied to the developer mix. Contrawise, if the toner particle concentration level is above the predetermined level, no request for toner particles is received and additional toner particles are not furnished to the developer mix. Systems of this type are not usually critically damped and may hunt about the desired toner particle concentration level. An attempt to overcome the foregoing is described in U.S. Pat. No. 3,873,002 issued to Davidson et al. in 1975. As described therein, the electrical output signals from the photosensor are processed by a hard wired or a nonvariable program which establishes the sequence of dispensing toner particles to the developer mix. Thus, toner particles are only added to the developer mix, when a predetermined number of dispense requests are received. However, an inherent disadvantage to the foregoing is that the program is fixed. Thus, it may be difficult to employ the same program with differing machine configurations.

Accordingly, it is a primary object of the present invention to improve electrophotographic printing by utilizing a programmable control device so that the scheme for dispensing toner particles may be readily varied.

SUMMARY OF THE INVENTION

Briefly stated, and in accordance with the present invention, there is provided a control device for regulating particle dispensing from a storage container to a mix.

Pursuant to the features of the present invention, means sense the concentration of particles in the mix at predetermined sampling intervals. The sensing means generate successive signals indicative of the particle concentration within the mix at each sampling interval. Means are provided for summing the signals from the sensing means and forming a plurality of output signals therefrom. Programmable means operate on the output signal received from the summing means in accordance with an operator reprogrammable program to develop predetermined differing actuating signals energizing the storage container to dispense predetermined differing quantities of particles into the mix corresponding to the actuating signal transmitted thereto.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
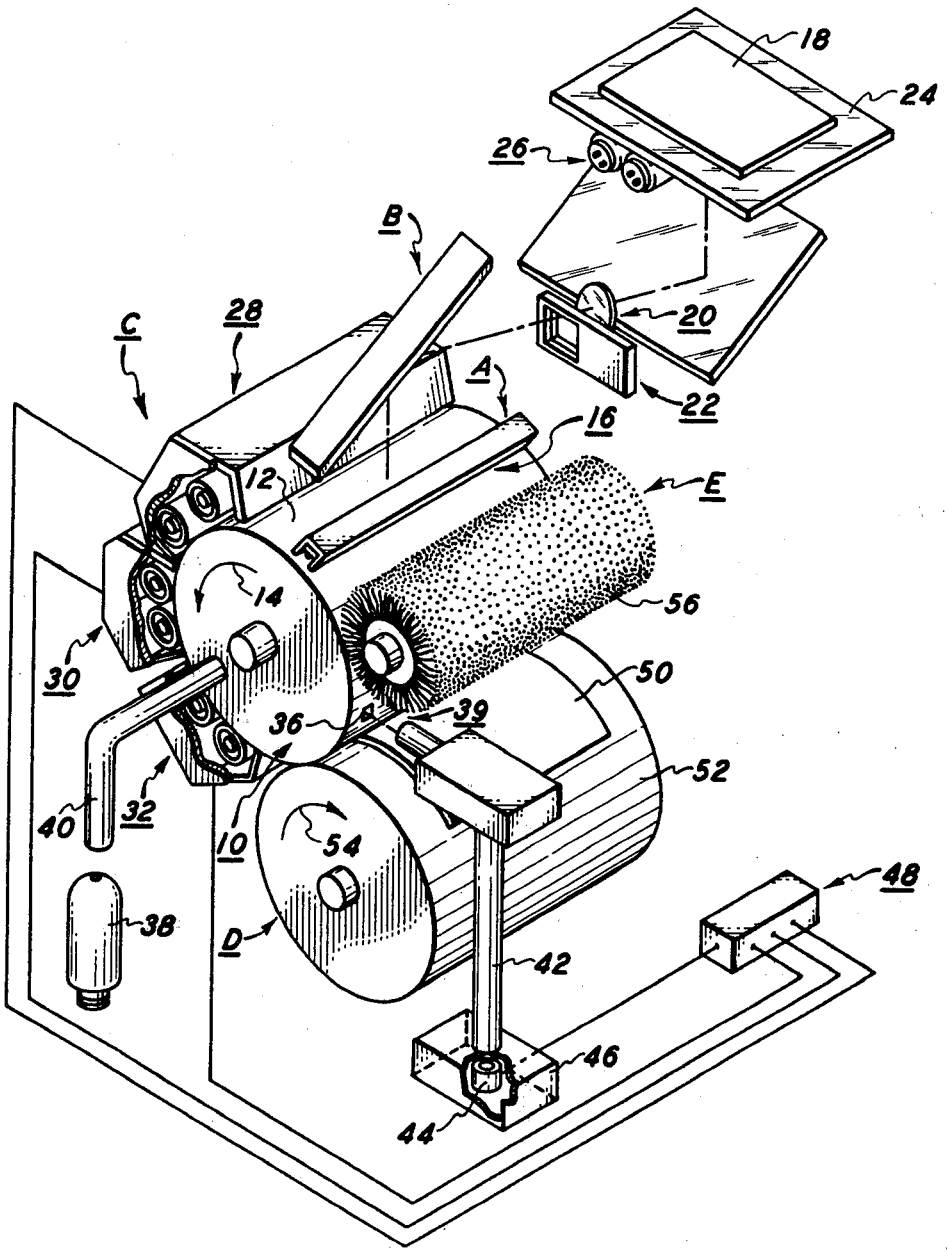
FIG. 1 is a schematic perspective view of a multicolor electrophotographic printing machine incorporating the features of the present invention therein.

For a general understanding of an electrophotographic printing machine in which the features of the present invention may be incorporated, reference is had to FIG. 1 which depicts schematically the various components thereof. Hereinafter, like reference numerals will be employed throughout to designate identical elements. Although the control device of the present invention is particularly well adapted for use in the electrophotographic printing machine depicted herein, it should become evident from the following discussion that it is equally well suited for use in a wide variety of electrostatographic printing machines, and is not necessarily limited in its application to the particular embodiment shown herein.

Inasmuch as the art of electrophotographic printing is well known, the various processing stations for producing a copy of an original document will be represented in FIG. 1 schematically. Each of these processing stations will be described briefly hereinafter.

As illustrated in FIG. 1, the electrophotographic printing machine employs a drum 10 having a photoconductive surface 12 secured to the exterior circumferential surface thereof. As drum 10 rotates in the direction of arrow 14, it passes through the various processing stations disposed about the periphery thereof. A suitable photoconductive material may be a selenium alloy of the type described in U.S. Pat. No. 3,655,377 issued to Sechak in 1972. A drive motor (not shown) rotates drum 10 at a predetermined speed relative to the operating stations of the printing machine. The machine logic coordinates the timing of the various operations with the rotation of drum 10 to produce the proper sequence of events at the respective processing stations. A timing wheel is mounted on the shaft of drum 10 to rotate therewith. The timing wheel has a plurality of slits therein. As light rays pass through the slits, a photosensor, disposed on the other side of the timing wheel, is actuated producing timing signals which are processed by the machine logic. The foregoing will be discussed in greater detail with reference to FIG. 2.

Initially, a portion of photoconductive surface 12 is rotated to charging station A. Charging station A includes a corona generating device, indicated generally by the reference numeral 16, positioned closely adjacent to photoconductive surface 12. Corona generating device 16 charges photoconductive surface 12 to a relatively high substantially uniform potential. A suitable corona generating device is described in U.S. Pat. No. 2,944,356 issued to Hayne in 1976.

After photoconductive surface 12 is charged to a substantially uniform potential, drum 10 is rotated to exposure station B. At exposure station B, a color filtered light image of original document 18 is projected onto the charged portion of photoconductive surface 12. Exposure station B includes a moving lens system, generally designated by the reference numeral 20, and a color filter mechanism, shown generally at 22. A suitable drive system for the optics is disclosed in U.S. Pat. No. 3,062,108 issued to Mayo in 1962. U.S. Pat. No. 3,592,531 issued to McCrobie in 1971 describes a suitable lens. Similarly, U.S. Pat. No. 3,775,006 issued to Hartman et al. in 1973 discloses a suitable filter mechanism. Original document 18, such as a sheet of paper, book or the like is placed face down upon transparent viewing platen 24. As shown in FIG. 1, lamps 26 are adapted to move in a timed relationship with lens 20 and filter mechanism 22 to scan successive incremental areas of original document 18 disposed upon platen 24. In this manner, a flowing light image of original document 18 is projected onto the charged portion of photoconductive surface 12. During the exposure process, filter mechanism 22 interposes selected color filters into the optical light path of lens 20. The appropriate filter operates on the light rays transmitted through lens 20 to record an electrostatic latent image on photoconductive surface 12 corresponding to a pre-selected spectral region of the electromagnetic wave spectrum, hereinafter referred to as a single color electrostatic latent image.

Next, the electrostatic latent image recorded on photoconductive surface 12 is rotated to development station C. At development station C, three individual developer units, generally indicated by the reference numerals 28, 30 and 32, respectively, are arranged to render visible the electrostatic latent image recorded on photoconductive surface 12. Preferably, the developer units are all of a type generally referred to in the art as "magnetic brush developer units". A typical magnetic brush developer unit employs a magnetizable development mix which comprises ferromagnetic carrier granules and toner particles triboelectrically attracted thereto. Generally, the toner particles are heat settable. In operation, the developer mix is continually brought through a directional flux field to form a chain-like array extending in an outwardly direction from the developer roll, frequently termed a brush. The electrostatic latent image recorded on photoconductive surface 12 is moved into contact with the brush of developer mix. Toner particles are attracted from the developer mix to the latent image. Each of the developer units contain appropriately colored toner particles corresponding to the complement of the spectral region of the wavelength of light transmitted through filter 22. For example, a green filtered electrostatic latent image is developed by depositing green absorbing magenta toner particles thereon. Similarly, blue and red filtered latent images are developed with cyan and yellow toner particles, respectively. A typical development station employing a plurality of developer units, as depicted in FIG. 1, is described in U.S. Pat. No. 3,940,272 issued to Davidson in 1976.

Pursuant to the features of the present invention, additional toner particles are added to the respective developer mixes when the concentration thereof is reduced beneath a specified level. The toner particle concentration is determined by a sensing means, indicated generally at 34. Sensing means 34 includes a transparent electrode assembly 36 mounted on photoconductive surface 12 of drum 10 in the non-image area thereof. A light source 38, in cooperation with fiber optics 40 and 42, transmits the light rays through transparent electrode assembly 36 to photosensor 44. As the electrostatic latent image recorded on photoconductive surface 12 is developed, toner particles are deposited on transparent electrode 36. The intensity of the light rays passing through transparent electrode 36 is indicative of the density of toner particles deposited thereon. Photosensor 44, disposed in thermal chamber 46, receives the light rays transmitted through transparent electrode 36. The logic circuitry, indicated generally by the reference numeral 48, is adapted to process the electrical output signal from photosensor 44. Logic circuitry 48 will be described hereinafter in greater detail with reference to FIGS. 2 through 4, inclusive. The output from circuit 48 actuates the respective toner particles storage container for dispensing toner particles into the developer mix of the appropriate developer unit when the concentration thereof is beneath a prescribed level.

Continuing now with the various processing stations associated with the printing machine depicted in FIG. 1, after development, the now visible image is advanced to transfer station D. At transfer station D, the toner powder image adhering electrostatically to photoconductive surface 12 is transferred to a sheet of final support material 50. Sheet 50 may be, amongst others, a sheet of paper or a sheet of thermoplastic material. A transfer roll, shown generally at 52, supports sheet 50 releasably thereon for movement in a recirculating path therewith. Transfer roll 52 is adapted to rotate in synchronism with drum 10 (in this case at substantially the same tangential velocity therewith). Hence, a plurality of toner powder images may be transferred from photoconductive surface 12 to support material 50, each toner powder image being in superimposed registration with the prior one. Image transfer is achieved by electrically biasing transfer roll 52 to a potential having the appropriate magnitude and polarity to attract electrostatically toner particles from the latent image recorded on photoconductive surface 12 to sheet 50. U.S. Pat. No.

3,612,677 issued to Landon et al. in 1971 describes a suitable electrically biased transfer roll. Transfer roll 52 includes a recess therein arranged to prevent photoconductive surface 12 from moving transparent electrode 36 with the toner particles thereon into contact therewith. Thus, the toner particles are not disturbed by the transfer process and represent a true indication of the concentration thereof within the developer mix.

Prior to proceeding with a discussion of the remaining processing stations, the sheet feeding path will be briefly described. A sheet of support material 50 is advanced by a sheet feeding apparatus to transfer roll 52. Sheet grippers secure sheet 50 thereto. The sheet feeding apparatus includes a feed roll contacting the uppermost surface of a stack of sheet of support material. The feed roll rotates to advance the uppermost sheet from the stack. Registration rollers align and forward the advancing sheet of support material into a chute. The chute directs the advancing sheet into contact with transfer roll 50 in a timed sequence so that the toner powder image on drum 10 is transferred thereto. After transferring a plurality of toner powder images to the sheet of support material, grippers space the sheet from transfer roll 52. The sheet then passes over a stripper bar and onto an endless belt conveyor. The endless belt conveyor advances the sheet of support material to the fusing station.

At the fusing station, the multi-layered toner powder image is permanently affixed to support material 50. One type of suitable fuser is described in U.S. Pat. No. Re. 28,802 issued to Draugelis et al. in 1976. Support material 50, with the toner powder image affixed thereto is, thereupon, advanced by conveyors to a catch tray. The catch tray is arranged to permit the machine operator to readily remove the completed copy from the printing machine.

Invariably, residual toner particles remain adhering to photoconductive surface 12 after the transfer of the toner powder image to the sheet of support material. These residual toner particles are removed from photoconductive surface 12 at cleaning station E. Cleaning station E includes a corona generating device and a brush 56 in contact with photoconductive surface 12. Initially, the toner particles are brought under the influence of the corona generating device to neutralize the electrostatic charge remaining on photoconductive surface 12 and that of the residual toner particles. Thereafter, the neutralized toner particles are removed from photoconductive surface 12 by the rotatably mounted fibrous brush 56 in contact therewith.

It is believed that the foregoing description is sufficient for purposes of the present application to illustrate the general operation of an electrophotographic printing machine which exemplifies one type of electrostatographic printing machine utilizing the teachings of the present invention therein.

Figure 2:
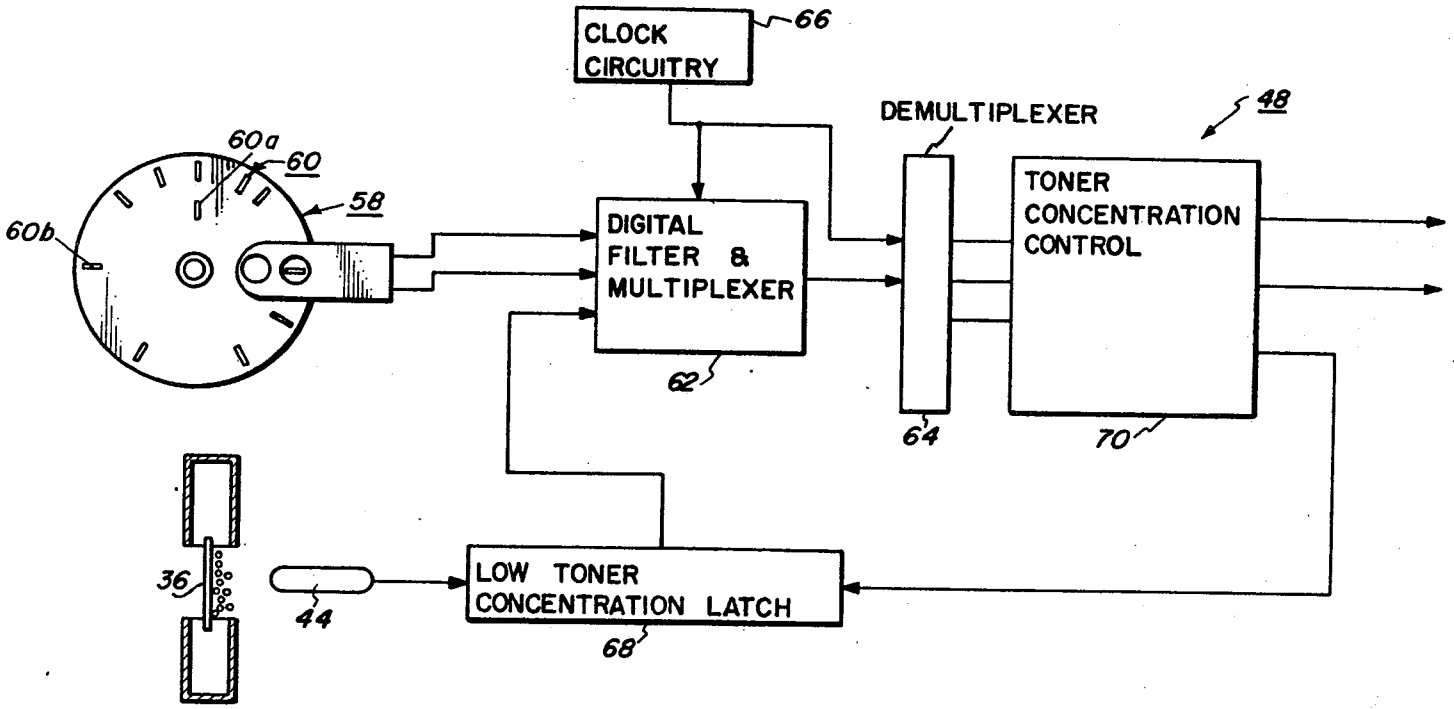
FIG. 2 is a block diagram of the control device of the present invention employed in the FIG. 1 printing machine.

Referring now to the specific subject matter of the present invention, FIG. 2 depicts the block diagram of the control scheme for metering predetermined quantities of toner particles into the developer mix of the corresponding developer unit. As shown in FIG. 2, an opaque timing wheel 58 has a plurality of slits 60 therein. Timing wheel 58 synchronizes the machine operation and has two channels of information. One channel has slot 60*a* indicating the initiation of another machine cycle. The other channel has slots 60*b* therein indicating the location of drum 10 as it rotates. Timing wheel 58 is mounted on the shaft of drum 10 and has a light source positioned on one side thereof with a photosensor being positioned on the other side thereof. The light source is arranged to transmit light rays through slots 60. These light rays excite the photosensor to develop a signal therefrom. The logic assembly reacts according to the machine time from timing wheel 58 and the other machine functions. Digital filter and multiplexer 62 is used to detect incoming signals and distinguish them from incorrect signals and transients. All inputs are polled in turn. During the polling of a signal input, the signal is tested seven times. A change in the signal at any one of these tests indicates the signal is unreliable and the signal is ignored. If the input signal is the same for all seven tests, the information is accepted and multiplexed onto an information buss and then decoded by demultiplexer 64.

As shown in FIG. 2, the input signal to multiplexer 62 is verified and made compatible with the logic levels used and transformed to an equivalent signal. A synchronizing clock 66 is employed to time the filtering, multiplexing and de-multiplexing of the signals. During each cycle in which a copy is developed, transparent electrode 36 is also developed and a sample of toner particles collected thereon. At some time in the machine cycle, low toner concentration latch 68 is armed by toner concentration circuitry 70. This time is dictated by timing wheel 58. At some later time, photosensor 44 is exposed to the light rays transmitted through transparent electrode 36. If the toner concentration is adequate, too little light is transmitted through transparent electrode 36 and latch 68 does not toggle. Shortly thereafter, latch 68 is unarmed. However, if the concentration of toner particles in the developer mix is too low, a greater amount of light is transmitted through transparent electrode 36 toggling latch 68. This sends a toner request signal to toner concentration control 70 via the multiplexing and de-multiplexing circuitry. During the next developing cycle, the toner concentration control circuit drives a motor which vibrates the appropriate storage container to add more toner particles into the respective developer mix. Each time a request signal is received, a counter is incremented by one in the toner concentration control circuit. If no request signal is received, the counter is set back to zero. When there are no requests for several cycles, the counter remains at zero. If a series of requests are received, due to the depletion of the toner particle supply, the concentration control will allow the request counter to increment to the terminal count and then latch itself up and cycle the machine out. This mode inhibits initiation of subsequent copy cycles which would produce inferior copies due to lack of toner particles in the developer mix. An exemplary dispense scheme is depicted in Table 1.

Table 1

| Cycle | Request for Additional Toner Particles | Additional Toner Particles Added to Developer Mix |
|---|---|---|
| 1 | No Request | No Dispense |
| 2 | First Request | One Third Dispense |
| 3 | Second Request | No Dispense |
| 4 | Third Request | Two Thirds Dispense |
| 5 | Fourth Request | No Dispense |
| 6 | Fifth Request | Full Dispense |
| 7 | Sixth Request | No Dispense |
| 8 | Seventh Request | Full Dispense |
| 9 | Eighth Request | Full Dispense |
| 10 | Ninth Request | Full Dispense |
| 11 | Tenth Request | Full Dispense |
| 12 | Eleventh Request | Full Dispense |
| 13 | Twelfth Request | Full Dispense |
| 14 | Thirteenth Request | Full Dispense |
| 15 | Fourteenth Request | Full Dispense |
| 16 | Fifteenth Request | Full Dispense |

Table 1-continued

| Cycle | Request for Additional Toner Particles | Additional Toner Particles Added to Developer Mix |
|---|---|---|
| 17 | — | Cycle Out |

After sixteen cycles, terminal count is reached. The no dispense cycles provide an extra cycle of developer mixing, prior to the next dispense. This dispense strategy insures that too great a quantity of toner particles is not added to the developer mix. A half dispense signal is a dispense signal which drives the motor oscillating the toner particle storage container at full amplitude for half the time of a full dispense. Similarly, a third dispense is a dispense signal which drives the motor at full amplitude for one third the time of a full dispense. This dispense scheme prevents two consecutive dispenses from producing too high a background when the toner concentration level is only slightly beneath the desired level. It also corrects for clogging of the storage container and allows the system to be at the correct value for reproducing high area coverage copies.

Figure 3:
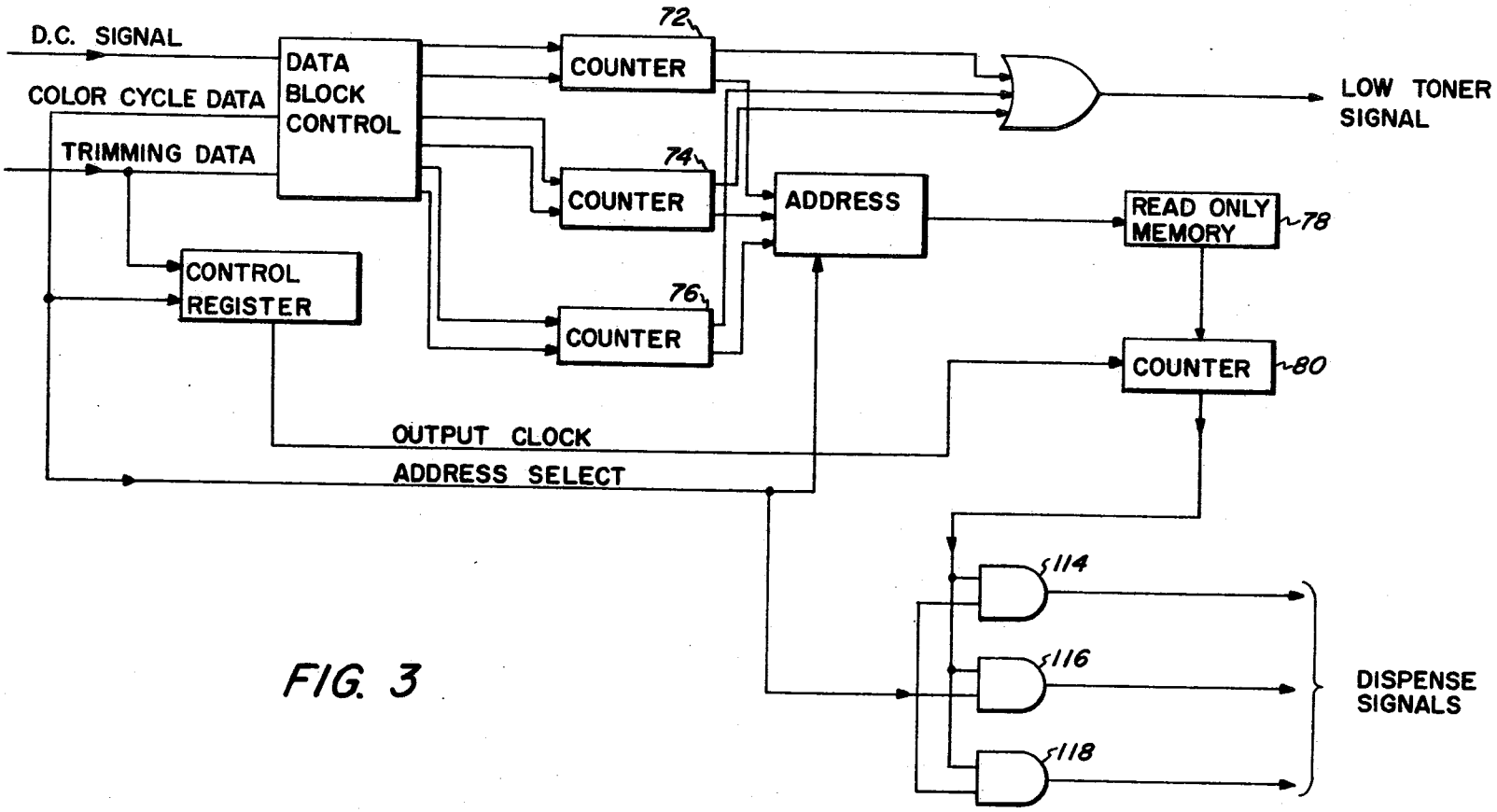
FIG. 3 is a block diagram depicting the programmable portion of the FIG. 2 control device.
Figure 4A:
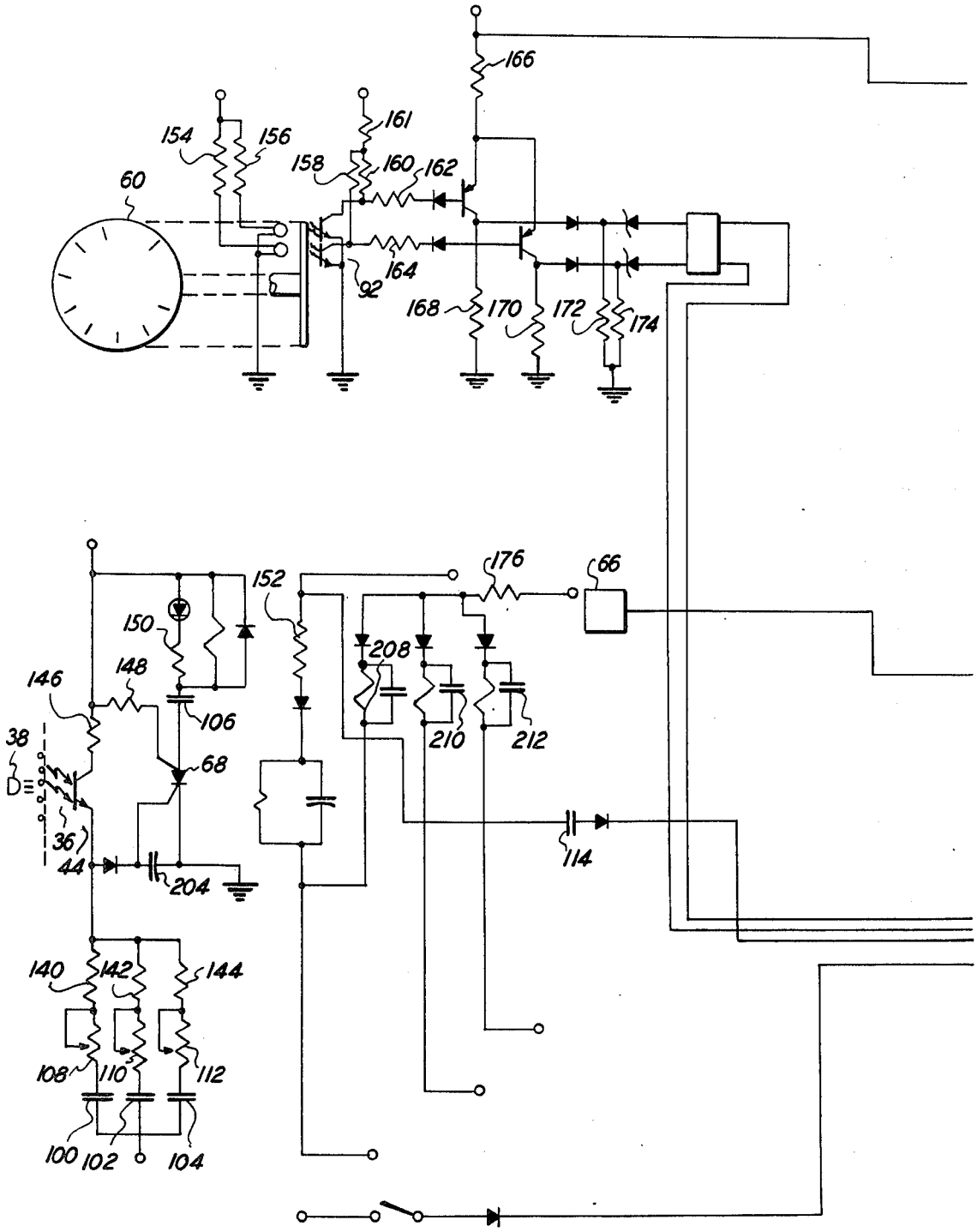
FIG. 4 is a detailed circuit diagram of the FIG. 2 control device.
Figure 4B:
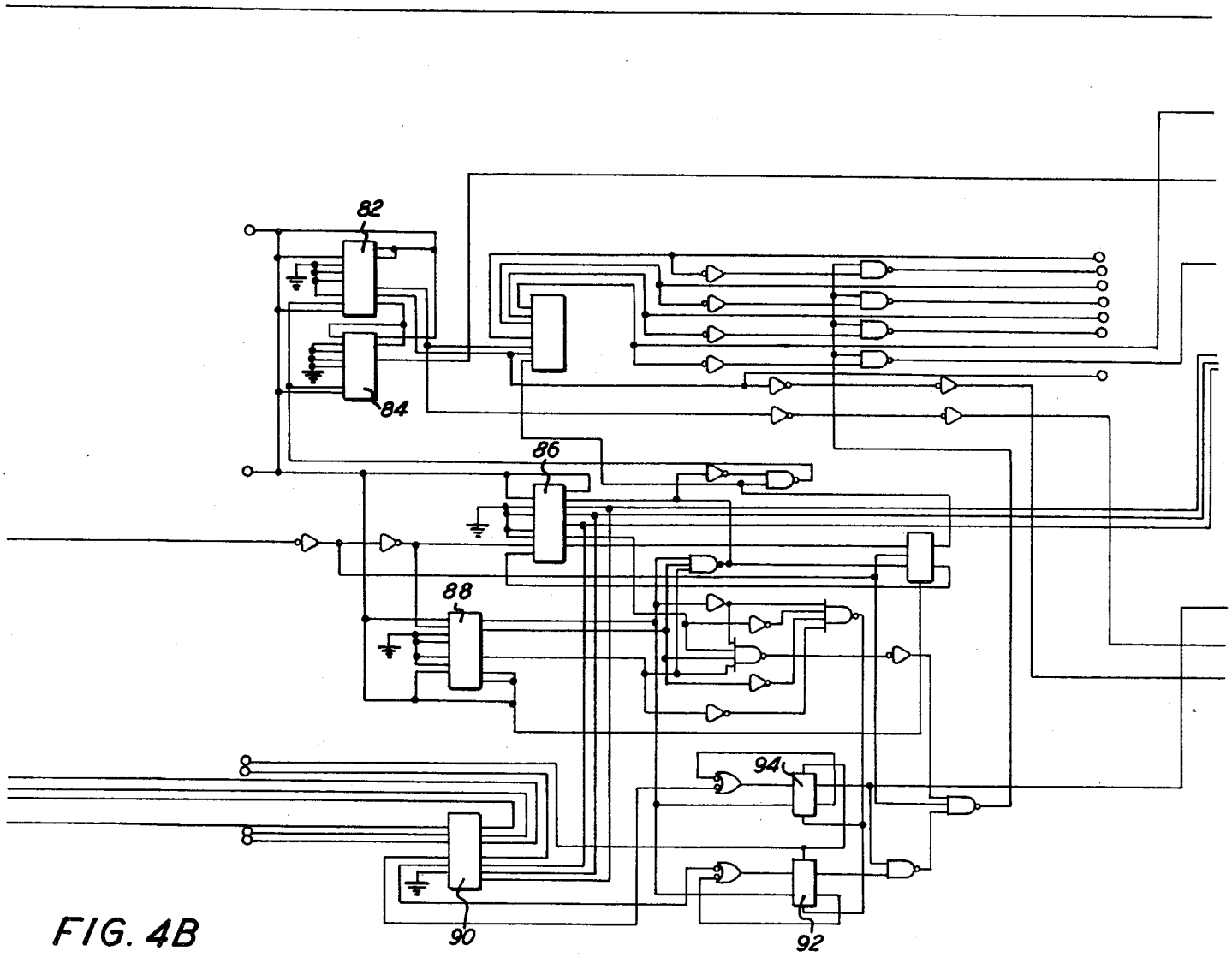
Figure 4C:
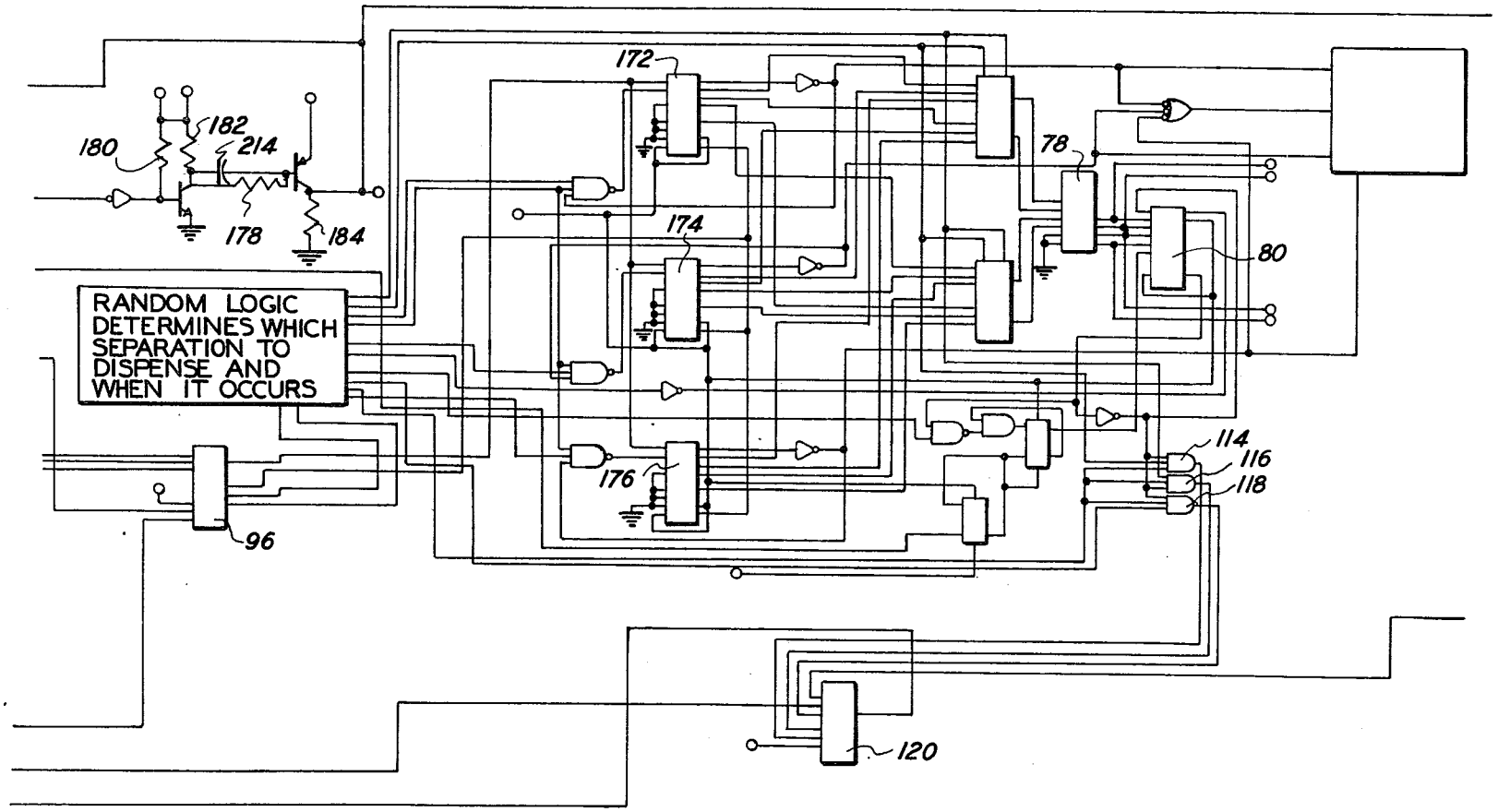
Figure 4D:
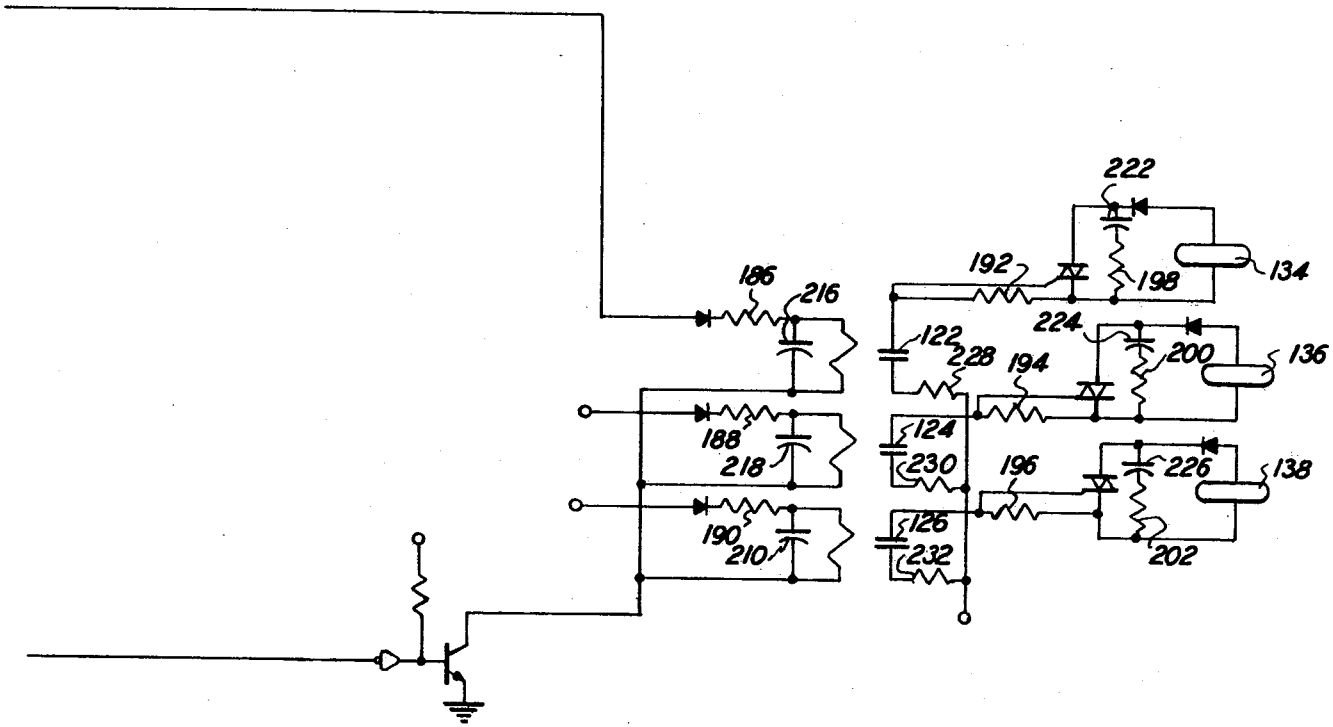

Referring now to FIG. 3, there is shown the programmable aspects of toner concentration control block 70. This system receives signals indicating that the density of the toner particles deposited on transparent electrode 36 has fallen below a preset limit. This signal is stored in counters 72, 74 and 76. One counter is employed for each of the developer units used in the printing machine. Timing signals from the logic heretofore described are used to select the proper register. Any signal requesting toner particles dispensing is stored in one of the counters until the next development cycle for the respective developer unit. If the signal is low when interrogated, the respective counter will be reset to a count of zero, as in the case when the density is above the set point and no dispense will be required. If the signal is high, when interrogated, the density is below the set point and the system will initiate a response to bring the density up to the set point. Prior to each development cycle, the respective counter is selected and the count is used to address read only memory 78. The read only memory program selected is then loaded into output counter 80. During the development cycle the output counter is enabled and counts until terminal count is reached. Thus, the data loaded from read only memory 78 will determine the length of the dispense. If the terminal count is loaded, the dispense length will be zero. For a load other than the terminal count there will be a finite length dispense which is determined by the data loaded from read only memory 78. As shown, this system addresses the output section of the machine logic to insure that the proper toner particle storage container is activated when a dispense signal is developed. Since each developer is activated at a different time of its respective cycle, the system must enable the output counter at a different time for each color cycle. When any individual toner supply is exhausted, the system will call for a dispense at each interrogation in the development cycle. The respective address counter will then be advanced to the terminal count. Each of the three address registers is monitored, when any register reaches the terminal count a low toner signal is generated and the machine will be placed in the cycle out mode. In addition, the machine logic will rotate a diagnostic disc to a position indicating to the operator that a specific toner supply has been exhausted. (Three different color toner supplies are employed).

Turning now to FIG. 4, the detailed circuitry for implementing the block diagrams of FIGS. 2 and 3 will now be described. Clock circuit 66 develops a 500 Kilohertz signal which generates the machine base time. Counters 82, 84, 86 and 88, in multiplexing circuit 62, divide the signal down so that four 256 microsecond pulses are produced with four 16 microseconds slots interposed therebetween. Each 256 microsecond pulse is subdivided into eight 32 microsecond pulses, each 32 microsecond pulse being sampled seven times. By knowing the state of each counter, it is possible to tell exactly where the system is in its initial base cycle. In this way, counter 90 demultiplexes the signals during each time frame. This system has the capability to monitor 32 sensors. Two photodarlington sensors 92 monitor timing wheel 58. One photodarlington detects the outside track of slots **60*b* and determines when each of the 32 slots occur during a machine cycle. The other photodarlington detects a single slot 60*a*** per revolution. These two signals may be employed to indicate the machine cycle and the point in the machine cycle. The signals, which are transmitted to the machine logic, are converted from 24 volt levels to 5 volt logic levels.

As shown, photosensors 44 are two photodarlington sensors for detecting the intensity of the light rays transmitted through transparent electrode 36 from light source 38. A reset switch is provided so that when the machine cover is opened the system memory is automatically reset. Incoming signals are demultiplexed in counter 90 and are sensed serially by logic elements 92 and 94 where noise rejection is accomplished. Noise free signals are transmitted to logic element 96 where each input is stored until the next cycle. The outputs from logic element 96 are representations of the sensor activities. Drive signals are controlled as a power driver and returned. The signals drive and return to complete a drive circuit. Fifty-six loads are controlled. The return signals must be synchronized with the drive signals. This is accomplished via signals from the multiplexing section.

In operation, at some machine indicated by the signals from timing wheel 58, and its associate circuitry and logic a particular separation is developed with the proper toner particle storage container. The same signal which engages the developer unit also engages either relays 100, 102 or 106. This is done to establish the biasing for photodarlingtons 44. At the beginning of development, transparent electrode 36 is developed with toner particles. When transparent electrode 36 is in alignment with light source 38 and photodarlingtons 44 the light transmitted therethrough is detected by photodarlingtons 44. Just prior to alignment, the sensing circuitry is disabled as switch 106 is de-energized. At some machine time, switch 106 is energized and photodarlingtons 44 are ready to detect light. The intensity of the light rays transmitted through transparent electrode 36 is an indication of the concentration of toner particles within the developer mix. If the intensity of the light rays detected is above the threshold established by relays 100, 102 or 104, and its associate resistors 108, 110 or 112, then latch 68 turns on which closes switch 114 and returns a signal to the logic calling for toner particles to be dispensed. Three separate biasing circuits are required, since each of the developer units employ toner particles having differing light transmission characteristics. This entire operation occurs subsequent to development. Latch 68 and relay 114 having been set will remain set even when light source 38 is removed therefrom. At some time later, the logic interrogates the signal transmitted through relay 114. Logic element 96 will decode this signal as requiring additional toner particles or not requiring additional toner particles. At an even later time, the logic de-energizes relay 106 which resets latch 68 and disables the sensing circuitry. The sensing circuitry is now ready to respond for the next successive cycle. When the logic receives a signal indicating that additional toner particles are required, counters 72, 74 or 76 are incremented. When a signal is received indicating that no additional toner particles are required, counters 72, 74 or 76 are capable of remembering from zero to fifteen different levels of toner particle requirements for each of the developer units. Also, consecutive signals must be received calling for additional toner particles in order to increment a register. However, a signal, indicating that no additional toner particles are required, clears the register and counting starts over again. In normal machine operation, consecutive signals indicating that no additional toner particles are required show adequate toner particle concentrations within the developer units. Under these circumstances, counters 72, 74 or 76 remain at zero. Only one counter is utilized at one time, to monitor each of the three developer units. Each register of counters 72, 74 or 76, respectively, remembers the number of signals received for dispensing additional toner particles to a particular developer unit. For instance, if a call for additional toner particles were registered in counter 74, it would be stored therein. However, if that developer unit were not used again that day, no other signals calling for additional toner particles would be registered. Machine geometry requires that the toner particle concentration be detected at the trail edge of the copy. At the trail edge, the developer units are de-energized. However, toner particles can only be added to the developer mix when the developer unit is energized and mixing. Hence, the call for additional toner particles is stored until the next development cycle in that developer unit. Early in the net cycle, the number stored in the register addresses read only memory 78 which is programmed with the length of dispense associated with this particular call. The number stored in read only memory 78 is loaded into counter 80 as a one complemented number. Counter 80 is inactive when it is at a count of 15. When development starts, a signal starts counter 80 counting which drives the dispense signal low. The signal is multiplexed in counter 120, level shifted and used to close relays 122, 124 or 126. When these relays close triacs 128, or 130 or 132 turn on and drive motors 134, 136 and 138 to vibrate the respective toner particle storage container. When counter 80 reaches the terminal count of 15, the dispense signal goes high and dispensing ceases. The base time period employed is $278.528 \times 10^{-3}$ seconds. Read only memory 78 may be programmed from 0 to 15 independently for each dispense signal.

By way of example, Table 2 presents a summary of the preferred values for the resistance and capacitance elements of the circuit depicted in FIG. 4. The table summarizes the nominal values of the capacitors and resistors utilized therein by reference numeral.

Table 2

| Resistor No. | Nominal Value Ohms | Capacitor No. | Nominal Value Microfarads |
|---|---|---|---|
| 108 | 100K | 204 | .56 |
| 110 | 100K | 206 | .56 |
| 112 | 100K | 208 | .56 |

Table 2-continued

| Resistor No. | Nominal Value Ohms | Capacitor No. | Nominal Value Microfarads |
|---|---|---|---|
| 140 | 100 | 210 | .56 |
| 142 | 100 | 212 | .56 |
| 144 | 100 | 214 | .01 |
| 146 | 1K | 216 | .56 |
| 148 | 100K | 218 | .56 |
| 150 | 100K | 220 | .56 |
| 152 | 100K | 222 | .05 |
| 154 | 1.5K | 224 | .05 |
| 156 | 1.5K | 226 | .05 |
| 158 | 18K | | |
| 160 | 18K | | |
| 161 | 100 | | |
| 162 | 2.2K | | |
| 164 | 2.2K | | |
| 166 | 100 | | |
| 168 | 15K | | |
| 170 | 15K | | |
| 172 | 2.7K | | |
| 174 | 2.7K | | |
| 176 | 22 | | |
| 178 | 1.2K | | |
| 180 | 27K | | |
| 182 | 560 | | |
| 184 | 75 | | |
| 186 | 22 | | |
| 188 | 22 | | |
| 190 | 22 | | |
| 192 | 1K | | |
| 194 | 1K | | |
| 196 | 1K | | |
| 198 | 100 | | |
| 200 | 100 | | |
| 202 | 100 | | |
| 228 | 51 | | |
| 230 | 51 | | |
| 232 | 51 | | |

In recapitulation it is apparent that the control device of the present invention dispenses a predetermined quantity of toner particles to the developer mix so as to maintain the concentration thereof at a substantially constant level. This is achieved by programmable logic circuitry. An operator may reprogram the Read Only Memory to adjust the dispense sequence.

It is, therefore, apparent that there has been provided, in accordance with the present invention, a programmable control device for regulating the concentration of toner particles in a developer mix employed within a printing machine development system that fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A control device for regulating particle dispensing from a storage container to a mix, including:

means for sensing the concentration of particles in the mix at predetermined sampling intervals, said sensing means generating successive signals indicative of the particle concentration within the mix at each sampling interval;

means for summing the signals from said sensing means and forming a plurality of output signals therefrom; and programmable means, operating on the output signals received from said summing means having operator reprogrammable circuitry to develop predetermined differing actuating signals energizing the storage container to dispense predetermined differing quantities of particles into the mix corresponding to the actuating signal transmitted therefor, said programmable means develops a first actuating signal energizing the storage container to dispense a first predetermined quantity of particles into the mix in response to said summing means generating an output signal indicating that said sensing means detected a particle level concentration beneath a predetermined level for one sampling interval, and said programmable means develops a second actuating signal energizing the storage container to dispense a second predetermined quantity of particles into the mix in response to said summing means generating an output signal indicating that said sensing means detected a particle level concentration beneath a predetermined level for at least three successive sampling intervals with the second predetermined quantity of particles being greater than the first predetermined quantity of particles.

2. A control device as recited in claim 1, wherein said programmable means includes:

a read only memory having the operator reprogrammable circuitry therein; and an output counter coupled to said read only memory and developing an actuating signal, in response to said read only memory transmitting thereof predetermined count, to energize the storage container.

3. An electrophotographic printing machine of the type having a toner particle storage container arranged to dispense predetermined quantities of toner particles therefrom into a developer mix, including:

means for sensing the concentration of toner particles in the developer mix at predetermined sampling intervals, said sensing means generating successive signals indicative of the particle concentration within the developer mix at each sampling interval;

means for summing the signals from said sensing means and forming a plurality of output signals therefrom; and programmable means, operating on the output signal received from said summing means having operator reprogrammable to circuitry to develop predetermined differing actuating signals energizing the storage container to dispense predetermined differing quantities of toner particles into the developer mix corresponding to the actuating signal transmitted thereto, said programmable means develops a first actuating signal energizing the storage container to dispense a first predetermined quantity of toner particles into the developer mix in response to said summing means generating an output signal indicating that said sensing means detected a particle level concentration beneath a predetermined level for one sampling interval, and said programmable means develops a second actuating signal energizing the storage container to dispense a second predetermined quantity of toner particles into the developer mix in response to said summing means generating an output signal indicating that said sensing means detected a toner particle level concentration beneath the predetermined level for at least three successive sampling intervals with the second predetermined quantity of particles being greater than the first predetermined quantity of particles.

4. A printing machine as recited in claim 3, wherein said programmable means includes:

a read only memory having the operator reprogrammable circuitry therein; and an output counter coupled to said read only memory and developing an actuating signal, in response to said read only memory transmitting thereto predetermined counts, to energize the storage container.

* * * * *